US006514058B1

(12) United States Patent
Chou

(10) Patent No.: US 6,514,058 B1
(45) Date of Patent: Feb. 4, 2003

(54) COMPRESSOR HAVING AN IMPROVED VALVED PISTON DEVICE

(76) Inventor: Wen San Chou, No. 15, Lane 833, Wen Hsien Road, Tainan 704 (TW)

( * ) Notice: Subject to any disclaimer, the term of this patent is extended or adjusted under 35 U.S.C. 154(b) by 18 days.

(21) Appl. No.: 09/908,923

(22) Filed: Jul. 20, 2001

(51) Int. Cl.[7] ..... F04B 39/10; F04B 53/12
(52) U.S. Cl. ..... 417/553; 417/313
(58) Field of Search ..... 417/313, 550, 417/552, 553, 503; 124/47 R

(56) References Cited

U.S. PATENT DOCUMENTS 4,077,750 A * 3/1978 Haake ..... 417/552
4,915,602 A * 4/1990 Tschopp ..... 417/503
4,958,601 A * 9/1990 Lyons ..... 124/47 R
5,174,735 A * 12/1992 Gannaway ..... 417/550
5,533,879 A * 7/1996 Chen ..... 417/553
5,556,268 A * 9/1996 Topper et al. ..... 417/553
5,655,887 A 8/1997 Chou ..... 417/63
5,674,055 A * 10/1997 Nimberger et al. ..... 417/313
6,095,758 A 8/2000 Chou ..... 417/63
6,135,725 A 10/2000 Chou ..... 417/360
6,280,163 B1 * 8/2001 Chou ..... 417/550

* cited by examiner

*Primary Examiner*—Teresa Walberg
*Assistant Examiner*—Leonid Fastovsky

(57) ABSTRACT

A compressor includes a piston slidably received in a chamber of a housing and having an annular groove for receiving a sealing ring, and having one or more conduits and having a number of openings communicating with the annular groove of the piston. The piston includes an inclined peripheral surface having a lower diameter greater the sealing ring for forcing the sealing ring to engage with the housing, and having an upper diameter less than that of the sealing ring for loosely receiving the sealing ring. A spring blade may selectively block the conduits of the piston.

19 Claims, 7 Drawing Sheets

COMPRESSOR HAVING AN IMPROVED VALVED PISTON DEVICE

BACKGROUND OF THE INVENTION

1. Field of the Invention

The present invention relates to a compressor, and more particularly to a compressor having an improved valved piston device.

2. Description of the Prior Art

Typical compressors comprise a piston slidably received in a piston housing and a sealing ring solidly engaged on the piston and engaged between the piston and the piston housing. The pistons of the typical compressors have no valves provided therein, such that the typical piston or the sealing ring may be easily damaged. In addition, a number of valve members are required for controlling the air into and out of the piston housing.

The applicant had developed various kinds of valved pistons, and issued as U.S. Pat. No. 5,655,887, to Chou, and U.S. Pat. No. 6,095,758, to Chou, and U.S. Pat. No. 6,135,725, to Chou, and comprise a complicated valved piston device for the compressors that may not be easily manufactured and assembled together and that may not be effectively operated.

The present invention has arisen to mitigate and/or obviate the afore-described disadvantages of the conventional compressors.

SUMMARY OF THE INVENTION

The primary objective of the present invention is to provide a compressor including a piston device having a sealing ring loosely engaged therein for preventing the sealing ring from solidly engaging with the piston housing and for preventing the piston from being easily damaged.

The other objective of the present invention is to provide a compressor including a piston device having a number of openings and an annular groove formed therein for loosely receiving the sealing ring and for allowing the openings to be communicated with the environment when the sealing ring is loosely received in the annular groove of the piston device.

The further objective of the present invention is to provide a compressor including a piston device having a spring blade for blocking a conduit and for allowing the air to flow into the cylinder housing only and for preventing the air from flowing out of the cylinder housing.

The still further objective of the present invention is to provide a compressor including a piston device having a spring blade for blocking a number of conduits, and having a sealing ring received in an inclined outer annular groove of the piston, for forming a double security structure.

In accordance with one aspect of the invention, there is provided a valved piston device for a compressor, the valved piston device comprising a housing including a chamber formed therein, a piston slidably received in the chamber of the housing, the piston including an outer peripheral portion having an annular groove formed therein and defined by an inclined inner peripheral surface, and including an upper portion having a plurality of openings formed therein and communicating with the annular groove of the piston, and a sealing ring received in the annular groove of the piston. The inclined inner peripheral surface of the piston includes a lower portion having a diameter greater than that of the sealing ring for forming a lower portion of the annular groove of the piston and for forcing the sealing ring to engage with the housing, and includes an upper portion having a diameter less than that of the sealing ring for forming an upper portion of the annular groove of the piston and for loosely receiving the sealing ring in the upper portion of the annular groove of the piston, the openings of the piston are communicating with the annular groove of the piston and communicating with the chamber of the housing when the sealing ring is loosely received in the upper portion of the annular groove of the piston.

The housing includes a tube extended outward therefrom and includes a passage formed therein and communicating with the chamber of the housing and communicating with the tube, for allowing the air in the chamber of the housing to be forced to flow through the passage of piston and to flow through the tube when the piston is moved toward the tube.

The piston includes a plate disposed on top thereof, and means for securing the plate to the piston for defining the upper portion of the piston.

The piston further includes at least one conduit formed therein and communicating with the chamber of the housing with an environment, and a spring blade for selectively blocking the conduit of the piston and for allowing the air to flow through the conduit of the piston and to flow into the chamber of the housing when the piston is moved in a direction away from the housing.

The spring blade includes a first end or a middle or a center portion secured to the piston and includes at least one arm extended therefrom for blocking the conduit of the piston.

The conduits may be arranged in a circle in the piston. The spring blade includes a circular shape having a center portion secured to the piston and having a peripheral portion for blocking the conduits of the piston.

The openings of the piston may be opened toward a radially outer peripheral portion of the piston.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
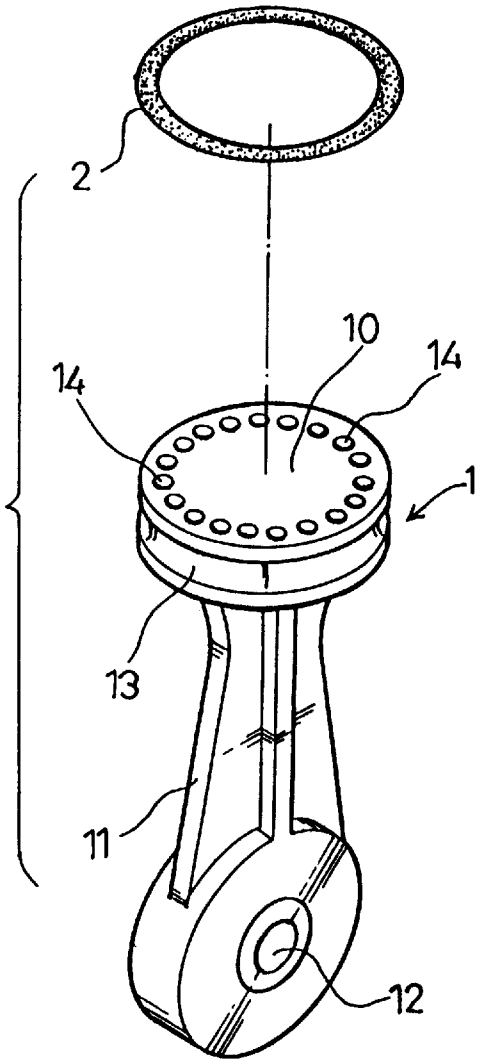
FIG. 1 is a partial exploded view of a valved piston device for a compressor in accordance with the present invention.
Figure 2:
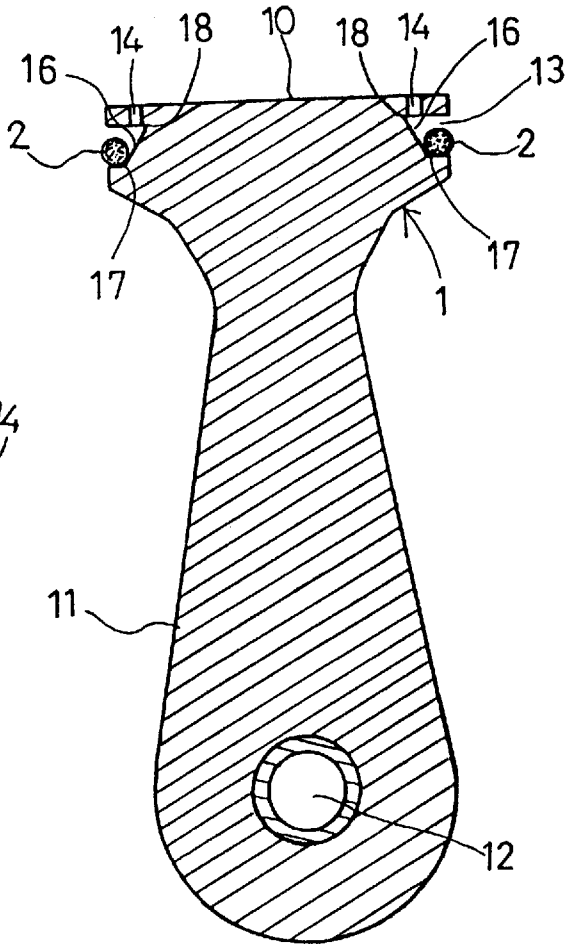
FIG. 2 is a cross sectional view taken along lines 2—2 of FIG. 3.
Figure 3:
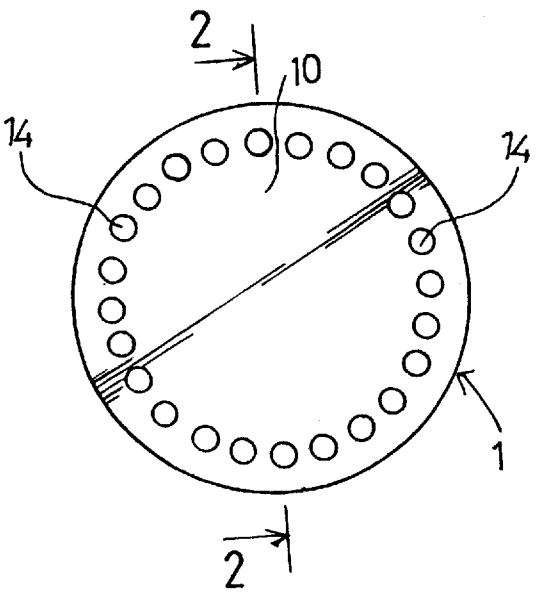
FIG. 3 is a top plane schematic view of the valved piston.
Figure 4:
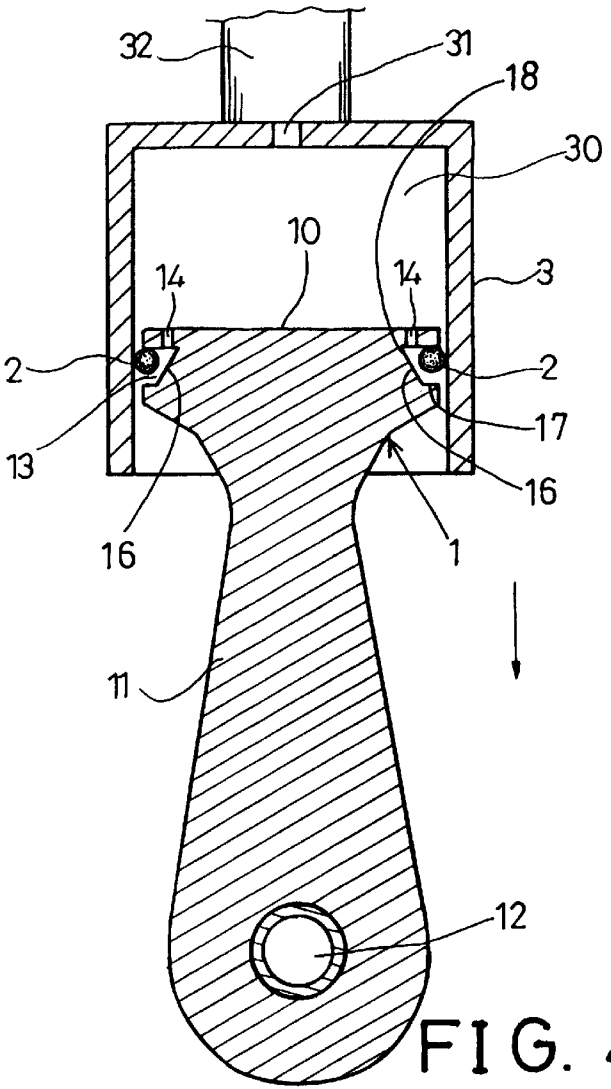
FIG. 4 is a partial cross sectional view showing a cylinder housing and a valved piston slidably engaged in the cylinder housing.

Referring to the drawings, and initially to FIGS. 1–4, a valved piston device for a cylinder or an actuator or an air compressor in accordance with the present invention comprises a cylinder housing 3 including a chamber 30 (FIG. 4) formed therein for slidably receiving a piston 1 therein. The housing 3 includes a passage 31 formed therein for communicating the chamber 30 of the housing 3 with a tube 32 which may direct or guide or introduce the pressurized air or compressed air out of the cylinder housing 3. The piston 1 includes a rod 11 extended therefrom and extended outward of the housing 3 and having an orifice 12 formed therein for coupling to and for being driven by a motor (not shown), and for allowing the piston 1 to be moved along the housing 3 in a reciprocating action by the motor (not shown). The driving of the piston 1 along the housing 3 has been disclosed in U.S. Pat. No. 5,655,887, to Chou, and U.S. Pat. No. 6,095,758, to Chou, and U.S. Pat. No. 6,135,725, to Chou, which are taken as a reference for the present invention.

Figure 5:
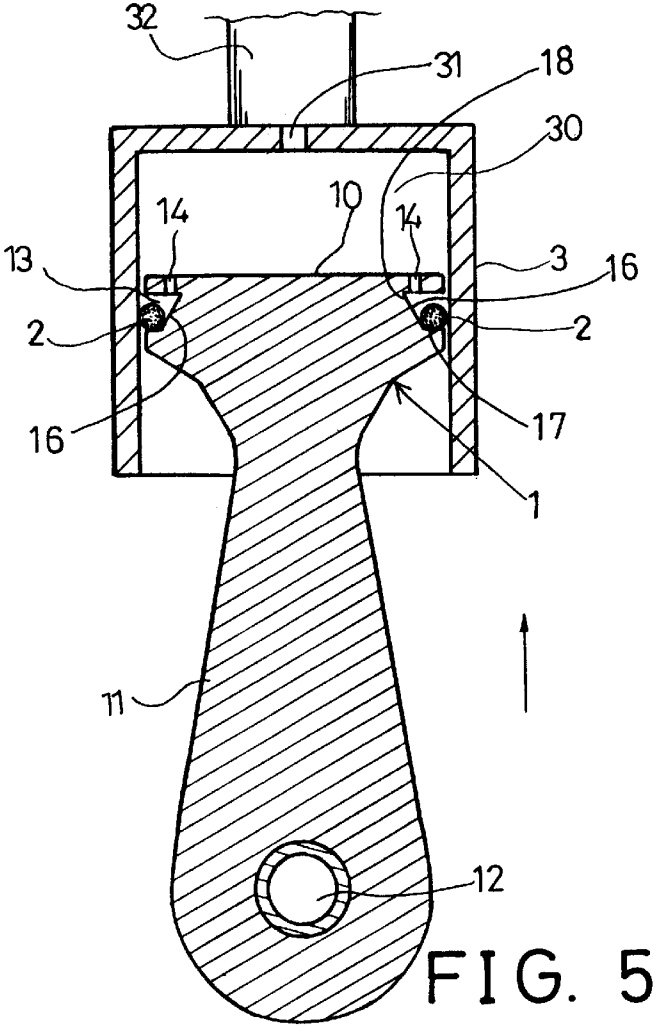
FIG. 5 is a partial cross sectional view similar to FIG. 4, illustrating the sliding engagement of the valved piston in the cylinder housing.

The piston 1 includes an annular groove 13 formed in the outer peripheral portion for receiving a sealing ring 2 therein, and formed or defined by an inner peripheral surface 16 that is inclined or tilted relative to the longitudinal direction or axis of the piston rod 11 and the piston 1. The sealing ring 2 is provided for making an air tight seal between the piston 1 and the housing 3. The inclined inner peripheral surface 16 of the piston 1 includes a lower peripheral portion having a diameter greater than that of the sealing ring 2, for forcing the sealing ring 2 radially outward to engage with the housing 3 and to make an air tight or a water tight seal with the housing 3 (FIG. 5). The inclined inner peripheral surface 16 of the piston 1 includes an upper peripheral portion 18 having a diameter less than that of the sealing ring 2 (FIG. 4), for loosely receiving the sealing ring 2, and for allowing the sealing ring 2 to be disengaged from the housing 3.

The piston 1 includes an upper portion 10 having three or more openings 14 formed therein and communicating the annular groove 13 of the piston 1 with the chamber 30 of the housing 3. Particularly, the three or more openings 14 are arranged in a circle that has a diameter less than that of the upper peripheral portion 18 of the inclined inner peripheral surface 16 of the piston 1, but has a diameter greater than that of the sealing ring 2, best shown in FIGS. 2, 4, 5, for allowing the air in the chamber 30 of the housing 3 to flow out through the openings 14 and the annular groove 13 of the piston 1 and to flow bypass the sealing ring 2 and then to flow out of the housing 3 when the sealing ring 2 is loosely received in the upper portion of the annular groove 13, best shown in FIG. 4. Relatively, the air may also flow through the annular groove 13 and the openings 14 of the piston 1 and then may flow bypass the sealing ring 2 and then may flow into the chamber 30 of the housing 3 when the sealing ring 2 is loosely received in the upper portion of the annular groove 13.

In operation, the piston 1 may be moved up and down along the housing 3 in a reciprocating action by the typical motor (not shown). When the piston 1 is moved in an active direction, i.e., moved toward the tube 32, the sealing ring 2 is forced toward the lower portion 17 of the inclined inner peripheral surface 16 of the piston 1 and thus may be forced to engage with the housing 3 such that the air in the chamber 30 of the housing 3 may be forced into the tube 32 through the passage 31 (FIG. 5). When the piston 1 moves downward or away from the tube 32, the air may flow into the chamber 30 of the housing 3 via the annular groove 13 of the piston 1 and the notches 14 of the piston 1. The air may then be forced into the tube 32 again when the piston 1 is forced toward the tube 32 again. The air may thus be effectively forced through the tube 32 without the other valve members.

It is to be noted that the formation or the provision of the openings 14 that are arranged in a circle in the piston 1 may facilitate the evenly flowing of the air bypass the sealing ring 2, even when the sealing ring 2 is unevenly received in the annular groove 13 of the piston 1 and when the sealing ring 2 blocks some of the openings 14 of the piston 1.

Figure 6:
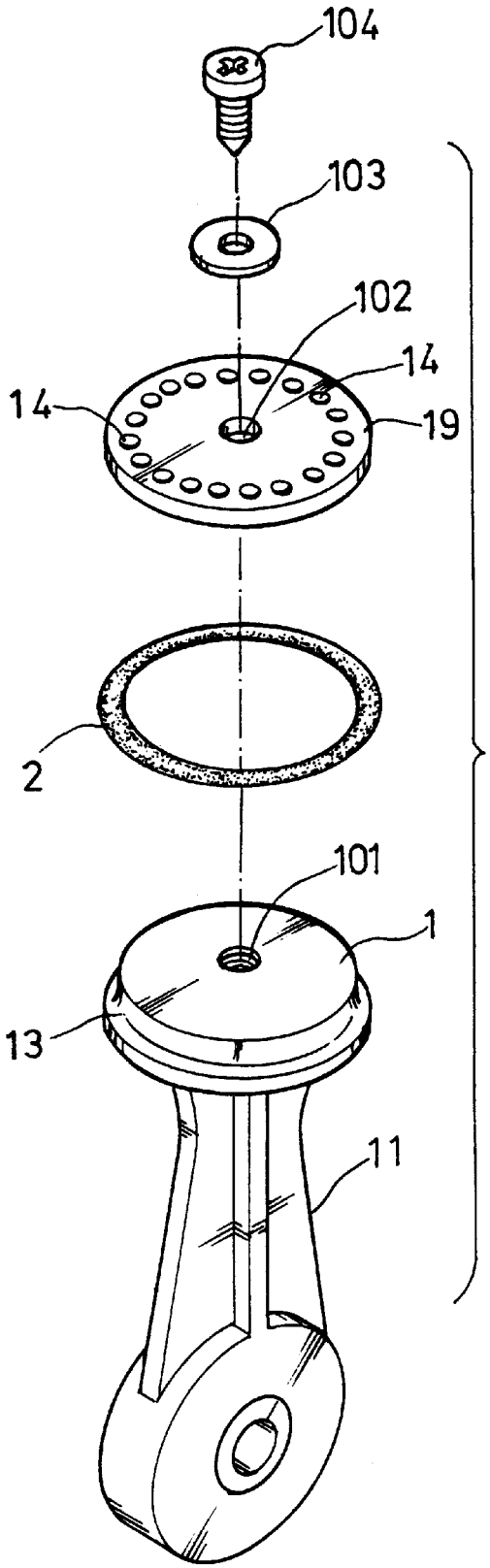
FIG. 6 is a partial exploded view illustrating another embodiment of the valved piston.

Referring next to FIG. 6, the piston 1 may include a screw hole 101 formed therein, and a plate 19 having the openings 14 formed therein and having an aperture 102 formed in the middle portion thereof for receiving a fastener 104 which may be threaded with the screw hole 101 of the piston 1 and which may secure the plate 19 onto the top of the piston 1, for forming the upper portion 10 of the piston 1. A washer 103 may be engaged between the plate 19 and the fastener 104.

Figure 7:
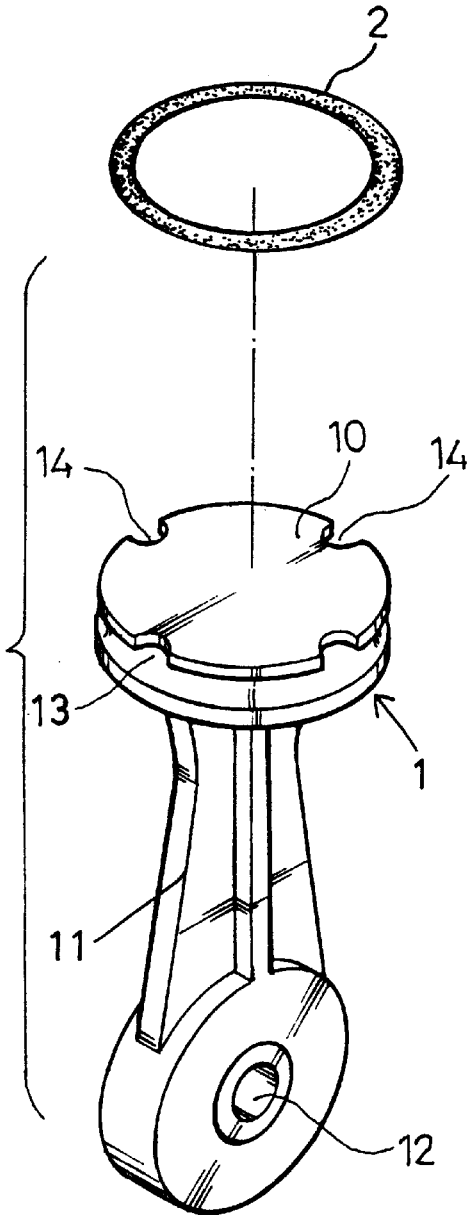
FIG. 7 is a partial exploded view illustrating a further embodiment of the valved piston.
Figure 8:
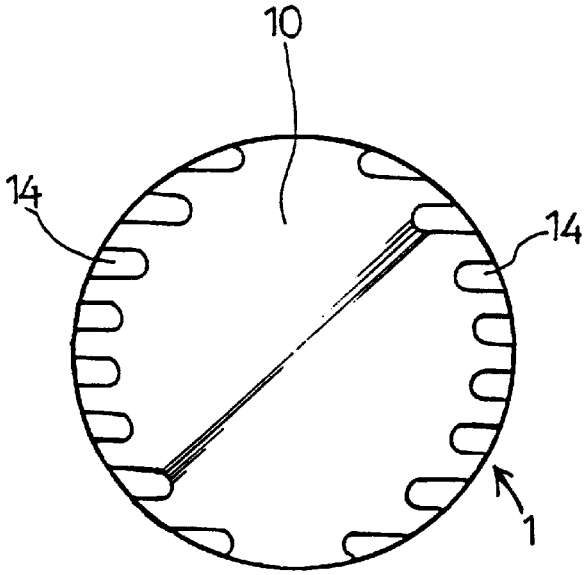
FIGS. 8 and 9 are top plane schematic views illustrating two still further embodiments of the valved piston.
Figure 9:
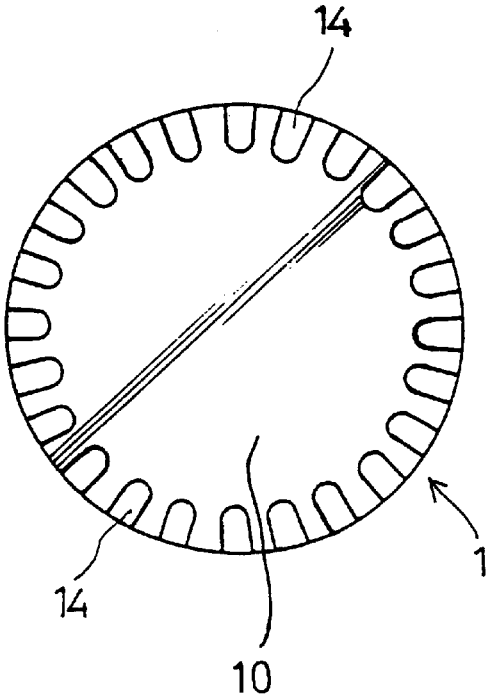
Figure 10:
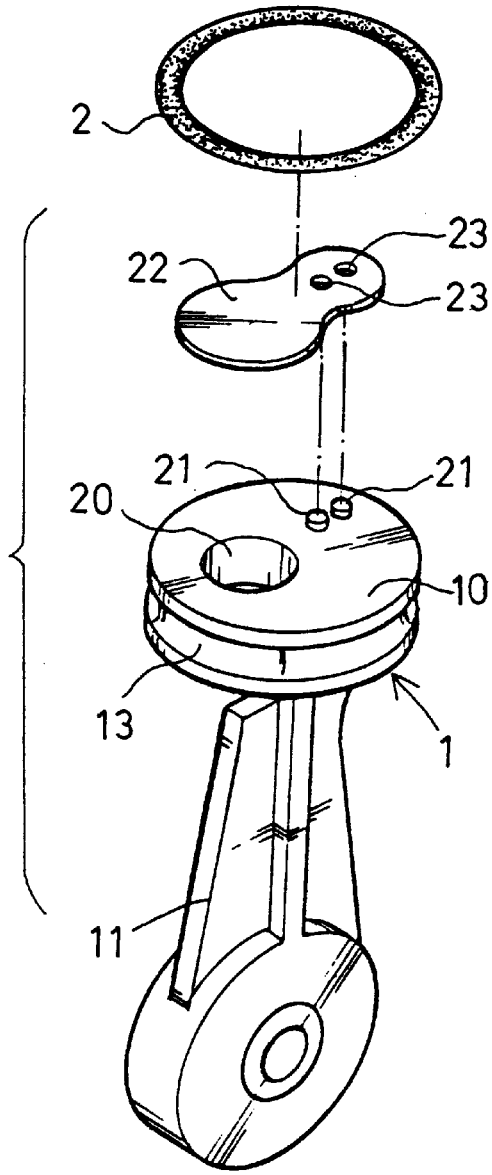
FIG. 10 is a partial exploded view illustrating a still further embodiment of the valved piston.
Figure 11:
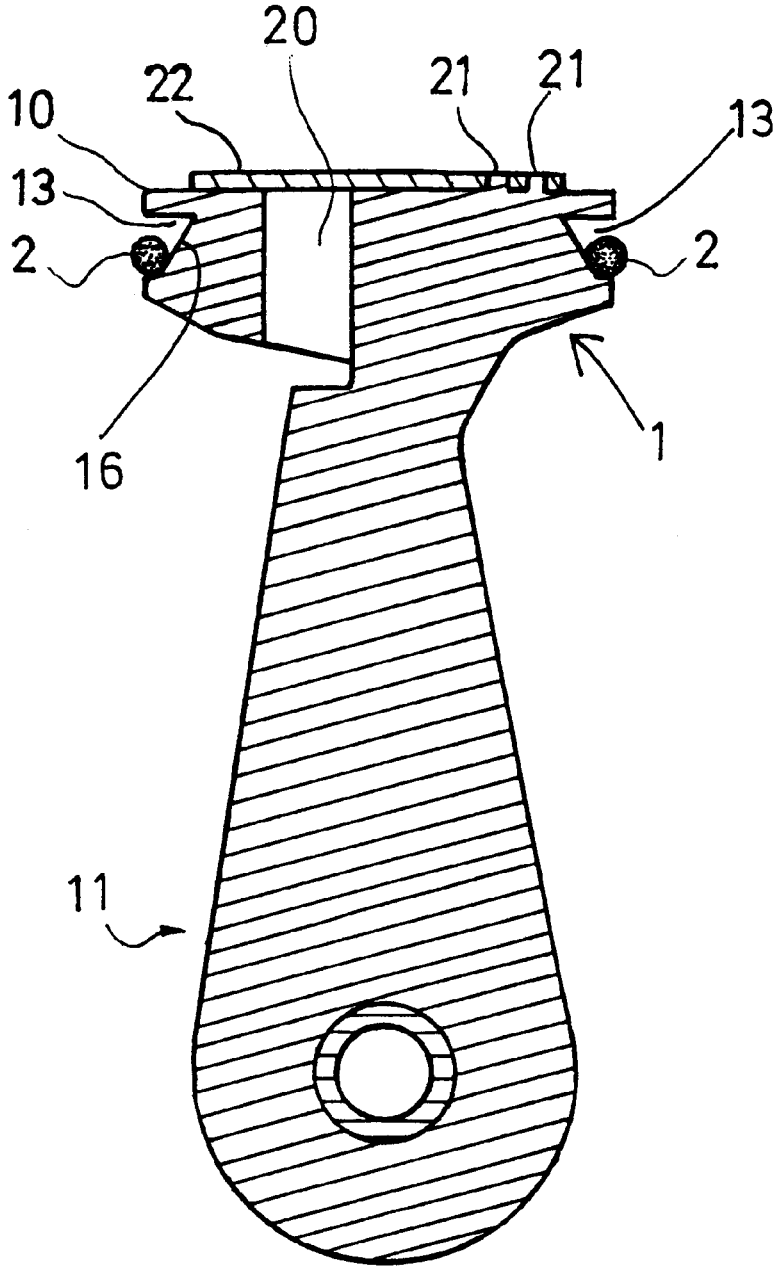
FIG. 11 is a cross sectional view taken along lines 11—11 of FIG. 12.
Figure 13:
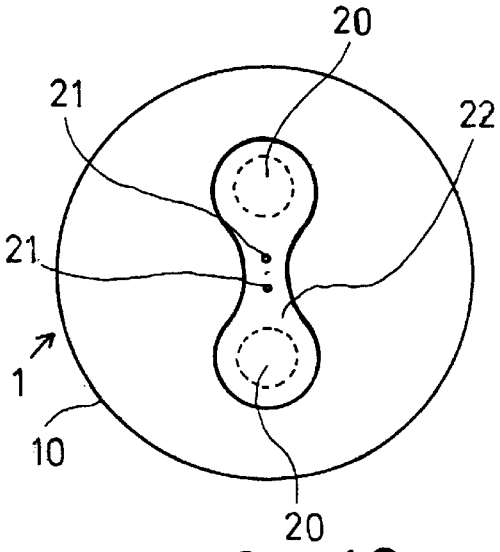
FIGS. 13, 14, 15, 16, 17, 18, 19 are top plane schematic views illustrating seven still further embodiments of the valved piston.
Figure 12:
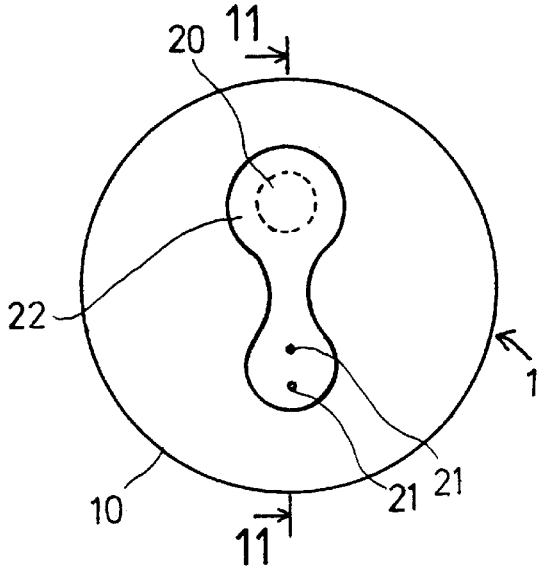
FIG. 12 is a top plane schematic view of the valved piston as shown in FIGS. 10 and 11.
Figure 15:
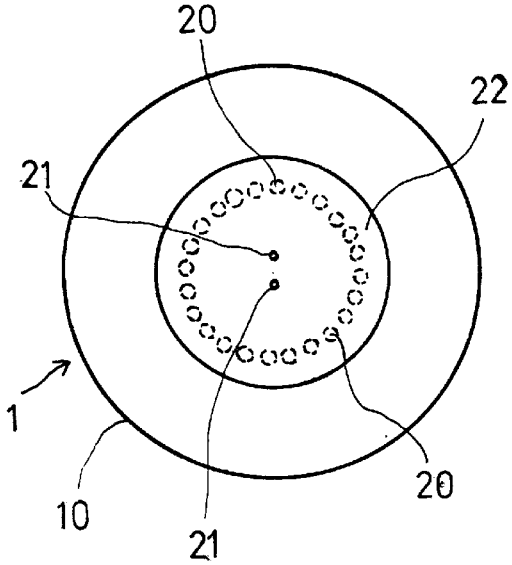
Figure 14:
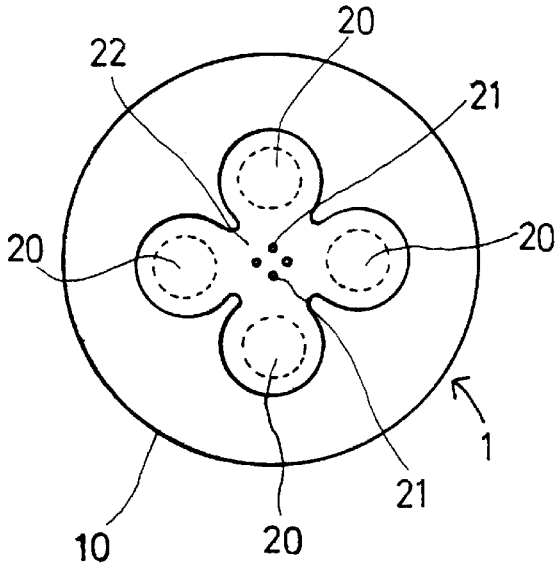
Figure 17:
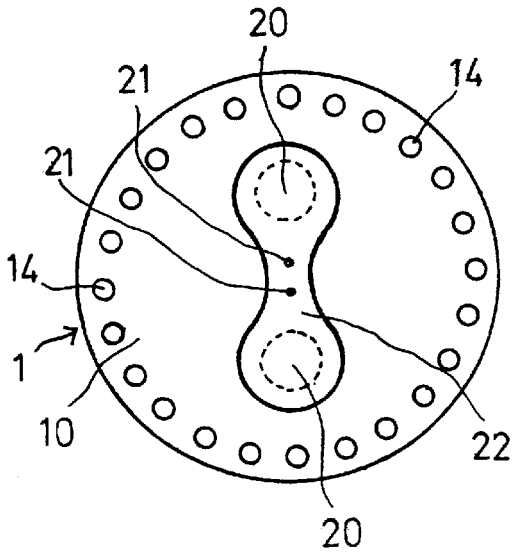
Figure 16:
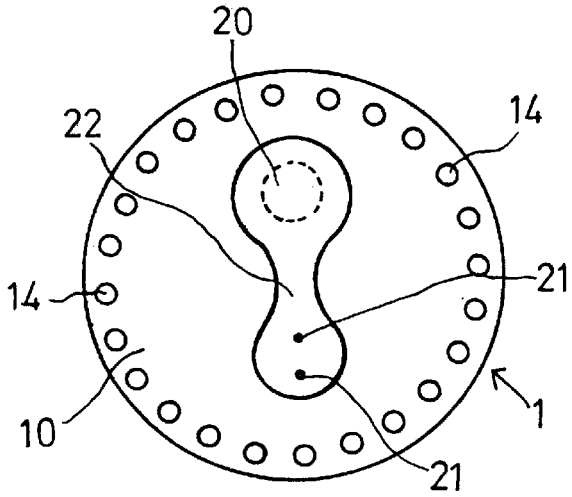
Figure 19:
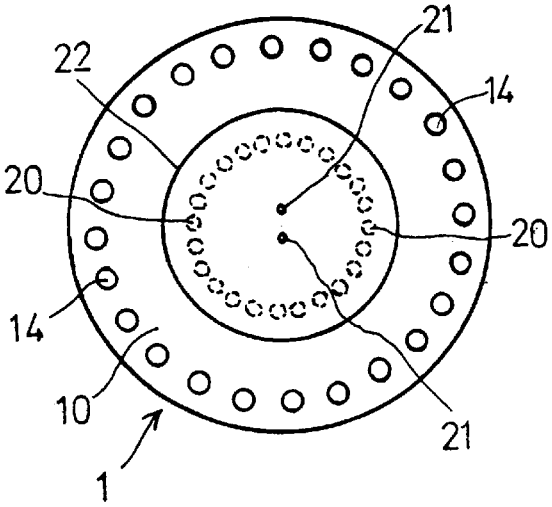
Figure 18:
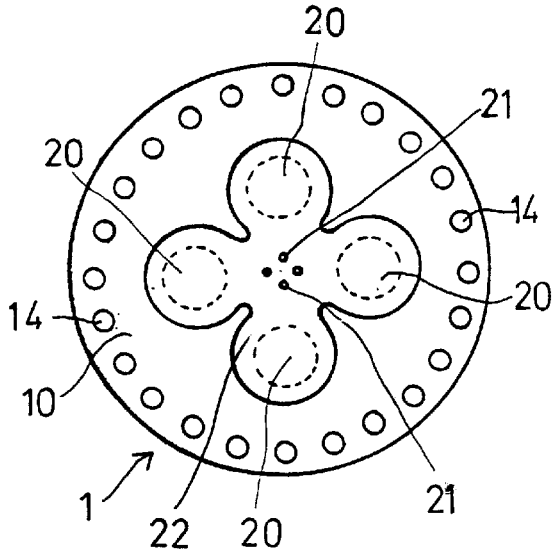

Referring next to FIGS. 7–9, illustrated is another embodiment of the valved piston device which includes the openings 14 that are opened toward the radially outer peripheral portion of the upper portion 10 of the piston 1. The openings 14 may be arranged parallel to each other (FIG. 8) or arranged radially and opened radially outward (FIGS. 7, 9). The air may also flow through the annular groove 13 and the openings 14 of the piston 1 and then may flow bypass the sealing ring 2 and then may flow into the chamber 30 of the housing 3 when the sealing ring 2 is loosely received in the upper portion of the annular groove 13.

Referring next to FIGS. 10–19, illustrated are the other embodiments of the valved piston device. The piston 1 includes one conduit 20 (FIGS. 10, 11, 12, 16), or two conduits 20 (FIGS. 13, 17), or more conduits (FIGS. 14, 15, 18, 19) formed therein and formed through the piston 1 for communicating the chamber 30 of the housing 3 with the environment, and for allowing the air to flow into and outward of the chamber 30 of the housing 3. The piston 1 includes one or more projections 21 provided or extended from the upper portion 10 thereof. A valve blade or a spring blade 22 includes one end portion secured to the piston 1 with the projections 21 (FIGS. 10, 11, 12, 16), and the other end for biasing against the upper portion 10 of the piston 1 and for blocking the conduits 20 of the piston 1 respectively and for preventing the air to flow out of the cylinder housing 3 when the piston 1 is moved away from the tube 32 (FIGS. 4, 5) and for allowing the air to flow into the cylinder housing 3 when the piston 1 is moved toward the tube 32 (FIGS. 4, As shown in FIGS. 13–15 and 17–19, the spring blade 22 may include various kinds of shapes having a middle or a center portion secured to the piston 1 with the projections 21, and having the other portion, such as the peripheral portion for biasing against the upper portion 10 of the piston 1 and for blocking the conduits 20 of the piston 1 respectively. For example, the spring blade 22 may include a circular shape (FIGS. 15, 19), or may include two (FIGS. 13, 17) or more arms (FIGS. 14, 18) or extensions extended therefrom for blocking the conduits 20 of the piston 1. In addition to the conduits 20 of the piston 1, the piston 1 may further include a number of openings 14 formed in the outer peripheral portion thereof (FIGS. 16–19) for communicating with the annular groove 13 of the piston 1 and for further communicating with the environment.

Accordingly, the compressor includes a piston having a loosely received sealing ring for preventing the piston from being easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A valved piston device for a compressor, said valved piston device comprising:

a) a housing including a chamber formed therein, b) a piston slidably received in said chamber of said housing, said piston including an outer peripheral portion having an annular groove formed therein and defined by an inclined inner peripheral surface, and including an upper portion having a plurality of openings formed therein and communicating with said annular groove of said piston, and c) a sealing ring received in said annular groove of said piston, said inclined inner peripheral surface of said piston including a lower portion having a diameter greater than that of said sealing ring for forming a lower portion of said annular groove of said piston and for forcing said sealing ring to engage with said housing, and including an upper portion having a diameter less than that of said sealing ring for forming an upper portion of said annular groove of said piston and for loosely receiving said sealing ring in said upper portion of said annular groove of said piston, said openings of said piston being communicating with said annular groove of said piston and being communicating with said chamber of said housing when said sealing ring is loosely received in said upper portion of said annular groove of said piston.

2. The valved piston device according to claim 1, wherein said housing includes a tube extended outward therefrom and includes a passage formed therein and communicating with said chamber of said housing and communicating with said tube, for allowing the air in said chamber of said housing to be forced to flow through said passage of piston and to flow through said tube when said piston is moved toward said tube.

3. The valved piston device according to claim 1, wherein said piston includes a plate disposed on top thereof, and means for securing said plate to said piston for defining said upper portion of said piston.

4. The valved piston device according to claim 1, wherein said piston further includes at least one conduit formed therein and communicating with said chamber of said housing with an environment, and a spring blade for selectively blocking said at least one conduit of said piston and for allowing the air to flow through said at least one conduit of said piston and to flow into said chamber of said housing when said piston is moved in a direction away from said housing.

5. The valved piston device according to claim 4, wherein said spring blade includes a first end secured to said piston and includes at least one arm extended therefrom for blocking said at least one conduit of said piston.

6. The valved piston device according to claim 4, wherein said spring blade includes a middle portion secured to said piston and includes at least one arm extended therefrom for blocking said at least one conduit of said piston.

7. The valved piston device according to claim 4, wherein said spring blade includes a center portion secured to said piston and includes at least one arm extended radially therefrom for blocking said at least one conduit of said piston.

8. The valved piston device according to claim 1, wherein said piston further includes a plurality of conduits formed therein and arranged in a circle and communicating with said chamber of said housing with an environment, and a spring blade for selectively blocking said conduits of said piston and for allowing the air to flow through said conduits of said piston and to flow into said chamber of said housing when said piston is moved in a direction away from said housing.

9. The valved piston device according to claim 8, wherein said spring blade includes a circular shape having a center portion secured to said piston and having a peripheral portion for blocking said conduits of said piston.

10. The valved piston device according to claim 1, wherein said openings of said piston are opened toward a radially outer peripheral portion of said piston.

11. A valved piston device for a compressor, said valved piston device comprising:

a) a housing including a chamber formed therein, b) a piston slidably received in said chamber of said housing, said piston including an outer peripheral portion having an annular groove formed therein, c) a sealing ring received in said annular groove of said piston, said piston further including at least one conduit formed therein and communicating with said chamber of said housing with an environment, and a spring blade for selectively blocking said at least one conduit of said piston and for allowing the air to flow through said at least one conduit of said piston and to flow into said chamber of said housing when said piston is moved in a direction away from said housing.

12. The valved piston device according to claim 11, wherein said spring blade is secured to said piston and includes at least one arm extended therefrom for blocking said at least one conduit of said piston.

13. The valved piston device according to claim 11, wherein said spring blade includes a circular shape having a center portion secured to said piston and having a peripheral portion for blocking said at least one conduit of said piston.

14. The valved piston device according to claim 11, wherein piston includes an inclined inner peripheral surface for defining said annular groove thereof, and includes an upper portion having a plurality of openings formed therein and communicating with said annular groove of said piston.

15. The valved piston device according to claim 14, wherein said inclined inner peripheral surface of said piston includes a lower portion having a diameter greater than that of said sealing ring for forming a lower portion of said annular groove of said piston and for forcing said sealing ring to engage with said, housing, and includes an upper portion having a diameter less than that of said sealing ring for forming an upper portion of said annular groove of said piston and for loosely receiving said sealing ring in said upper portion of said annular groove of said piston, said openings of said piston are communicating with said annular groove of said piston and communicating with said chamber of said housing when said sealing ring is loosely received in said upper portion of said annular groove of said piston.

16. The valved piston device according to claim 14, wherein said piston includes a plate disposed on top thereof, and means for securing said plate to said piston for defining said upper portion of said piston.

17. The valved piston device according to claim 14, wherein said openings of said piston are opened toward a radially outer peripheral portion of said piston.

18. The valved piston device according to claim 11, wherein said housing includes a tube extended outward therefrom and includes a passage formed therein and communicating with said chamber of said housing and communicating with said tube, for allowing the air in said chamber of said housing to be forced to flow through said passage of piston and to flow through said tube when said piston is moved toward said tube.

19. A valved piston device for a compressor, said valved piston device comprising:

a) a housing including a chamber formed therein, b) a piston slidably received in said chamber of said housing, said piston including a plurality of conduits formed therein and arranged in a circle and communicating with said chamber of said housing with an environment, and c) a spring blade for selectively blocking said conduits of said piston and for allowing the air to flow through said conduits of said piston and to flow into said chamber of said housing when said piston is moved in a direction away from said housing, said spring blade including a circular shape having a center portion secured to said piston and having a peripheral portion for blocking said conduits of said piston.

* * * * *